US005657806A

United States Patent [19]

Hung

[11] Patent Number: 5,657,806

[45] Date of Patent: Aug. 19, 1997

[54] VENETIAN BLIND AND A SLAT THEREFOR

[76] Inventor: Tai-Lang Hung, No. 38, Min-Chuan Rd., Lu-Kang Cheng, Changhua Hsien, Taiwan

[21] Appl. No.: 634,822

[22] Filed: Apr. 19, 1996

[51] Int. Cl.[6] ..... E06B 9/30

[52] U.S. Cl. ..... 160/168.1; 160/236

[58] Field of Search ..... 160/168.1 R, 176.1 R, 160/236, 173 R, 178.1 R, 172 R, 166.1 R, 107

[56] References Cited

U.S. PATENT DOCUMENTS

| | | | |
|---|---|---|---|
| 2,146,816 | 2/1939 | Grassby | 160/236 X |
| 2,254,705 | 9/1941 | Morse | 160/236 X |
| 2,603,286 | 7/1952 | Miao | 160/236 X |
| 2,757,727 | 8/1956 | Findell | 160/168.1 R |
| 3,032,099 | 5/1962 | Croxen | 160/168.1 R |
| 5,165,459 | 11/1992 | Gaber et al. | 160/168.1 R |
| 5,409,050 | 4/1995 | Hong | 160/168.1 R |

FOREIGN PATENT DOCUMENTS

| | | | |
|---|---|---|---|
| 729066 | 5/1955 | United Kingdom | 160/173 R |
| 2163472 | 2/1986 | United Kingdom | 160/236 |
| 9013728 | 11/1990 | WIPO | 160/236 |

*Primary Examiner*—David M. Purol
*Attorney, Agent, or Firm*—Cushman Darby & Cushman, IP Group of Pillsbury Madison & Sutro, LLP

[57] ABSTRACT

A Venetian blind includes an elongated top housing, a horizontally disposed shaft journaled in the top housing, a plurality of horizontal slats suspended one above another, a pair of pull ropes wound around the shaft, a bottom rail disposed below the slats, two pairs of tilting cords, and a plurality of suspending strings. Each of the slats has two opposite longitudinal sides and is formed with two through holes. Each of the pull ropes passes through the housing and through a respective one of the through holes of the slats and is mounted to the bottom rail. Each of the pairs of tilting cords is disposed on a respective one of the opposite longitudinal sides of the slats and has an upper end mounted to the shaft and a lower end mounted to the bottom rail. The suspending strings are disposed below each of the slats and connect one of the pairs of tilting cords to the other one of the pairs of tilting cords. Each of the slats includes a slat body with a substantially S-shaped cross-section. The slat body has a first curving portion with an upwardly curving cross-section and a second curving portion with a downwardly curving cross-section. The first curving portion has a width which is wider than that of the second curving portion and has two end sections formed respectively with one of the through holes.

2 Claims, 5 Drawing Sheets

VENETIAN BLIND AND A SLAT THEREFOR

BACKGROUND OF THE INVENTION

1. Field of the Invention

The invention relates to a Venetian blind, more particularly to a Venetian blind with an improved slat for achieving an excellent light blocking effect.

2. Description of the Related Art

Referring to FIG. 1, a conventional Venetian blind V is shown to include a top housing 1, a horizontally disposed shaft 2 journaled in the top housing 1, a pair of pull ropes 3 (only one is shown), a plurality of slats 4, four tilting cords 5 (only two are shown), and a plurality of suspending strings 6. The pull ropes 3 are provided below the top housing 1 and have one end mounted to a bottom rail 3*a* and an opposite end passing through the top housing 1. Each of the slats 4 has an upwardly curving cross-section and is formed with a convex side 4*a* and an opposite concave side 4*b*. A pair of through holes 4*c* (only one is shown) with appropriate widths are formed between two end portions of each slat 4 for passage of the pull ropes 3 therethrough. The tilting cords 5 are mounted to the shaft 2 and are provided on the two sides of the two end portions of the slats 4. Each of the suspending strings 6 connects two of the tilting cords 5 and is provided below one of the slats 4. The slats 4 are restricted by the tilting cords 5 and the suspending strings 6.

The slats 4 of the conventional Venetian blind V can be stacked together and the orientations thereof are adjustable. As shown in FIG. 2, since the through holes 4*c* are provided in the middle of the slats 4, when the slats 4 are adjusted to be in substantially upright positions, the distance between the pull ropes 3 and the tilting cords 5 is so great that the lower end of an upper slat 4 is not able to completely block the through holes 4*c* in a lower slat 4. Thus, light can pass through the slats 4 via the through holes 4*c*. Further, when light irradiates the concave side 4*b* of an upper slat 4, the light will be reflected to the convex side 4*a* of a lower slat 4, thus directing the light into the room. Consequently, the conventional Venetian blind is not capable of providing a satisfactory light blocking effect.

SUMMARY OF THE INVENTION

Therefore, the main object of this invention is to provide a Venetian blind which achieves an excellent light blocking effect. This object is accomplished by modifying the shape of the slats so that they are able to be in close contact with each other when they are adjusted to a substantially upright orientation.

According to one aspect of this invention, a Venetian blind which achieves an excellent light blocking effect is provided. The Venetian blind includes an elongated top housing, a horizontally disposed shaft journaled in the top housing, a plurality of horizontal slats suspended one above another, each of the slats having two opposite longitudinal sides and being formed with two through holes, a bottom rail disposed below the slats, a pair of pull ropes wound around the shaft, each of the pull ropes passing through the housing and through a respective one of the through holes of the slats and being mounted to the bottom rail, two pairs of tilting cords, each of the pairs of tilting cords being disposed on a respective one of the opposite longitudinal sides of the slats and having an upper end mounted to the shaft and a lower end mounted to the bottom rail, and a plurality of suspending strings disposed below each of the slats and connecting one of the pairs of tilting cords to the other one of the pairs of tilting cords. Each of the slats includes a slat body with a substantially S-shaped cross-section, the slat body having a first curving portion with an upwardly curving cross-section and a second curving portion with a downwardly curving cross-section, the first curving portion having a width which is wider than that of the second curving portion, the through holes being formed respectively in two end sections of the first curving portion.

According to another aspect of this invention, a slat for use in the Venetian blind of this invention is provided. The slat includes a slat body with a substantially S-shaped cross-section. The slat body is formed with a pair of through holes and has a first curving portion with an upwardly curving cross-section and a second curving portion with a downwardly curving cross-section. The first curving portion has a width which is wider than that of the second curving portion. The through holes are formed respectively in two end sections of the first curving portion.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
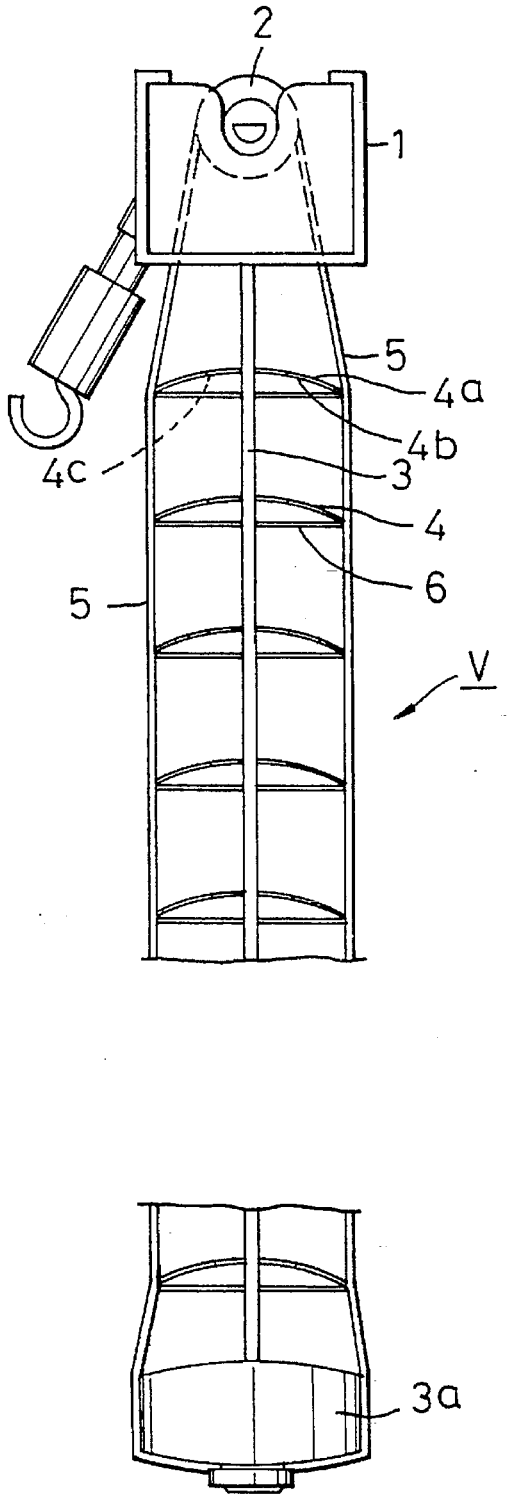
FIG. 1 PRIOR ART
FIG. 1 is a schematic view illustrating a conventional Venetian blind when in an open state.
Figure 2:
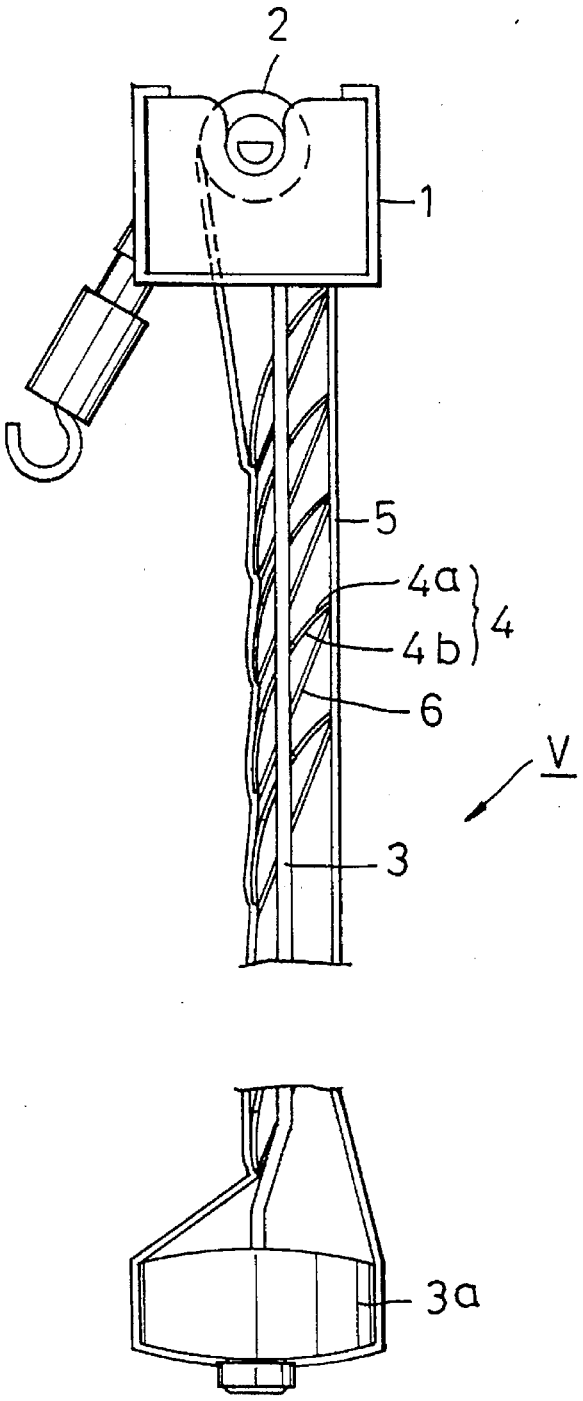
FIG. 2 PRIOR ART
FIG. 2 is a schematic view illustrating the conventional Venetian blind of FIG. 1 when in a closed state.
Figure 3:
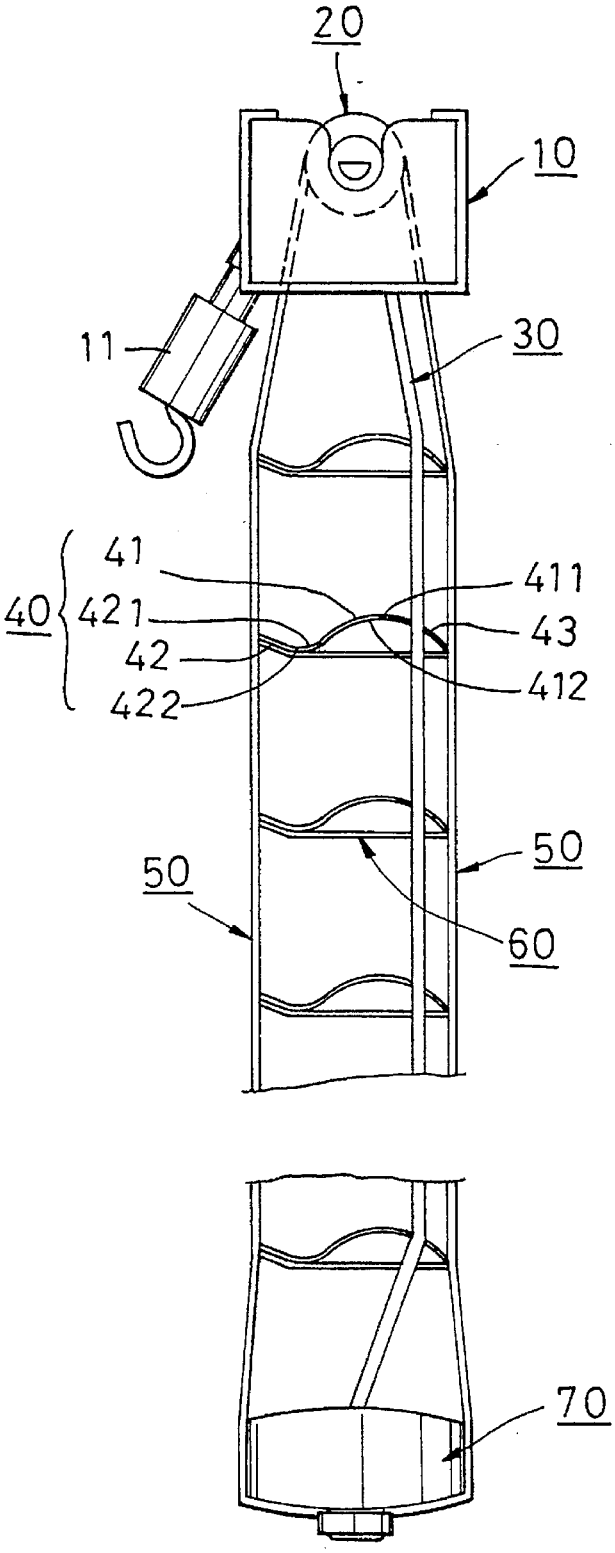
FIG. 3 is a schematic view illustrating a preferred embodiment of the Venetian blind of this invention.

Referring to FIG. 3, the preferred embodiment of a Venetian blind of this invention is shown to include an elongated top housing 10, a horizontally disposed shaft 20, a pair of pull ropes 30 (only one is shown), a plurality of slats 40, two pairs of tilting cords 50 (only one pair is shown), a plurality of suspending strings 60 and a bottom rail 70. Since the top housing 10, the shaft 20, the pull ropes 30, the tilting cords 50, the suspending strings 60 and the bottom rail 70 are known in the art, the structural relationships thereamong will not be described further in the succeeding paragraphs.

Figure 4:
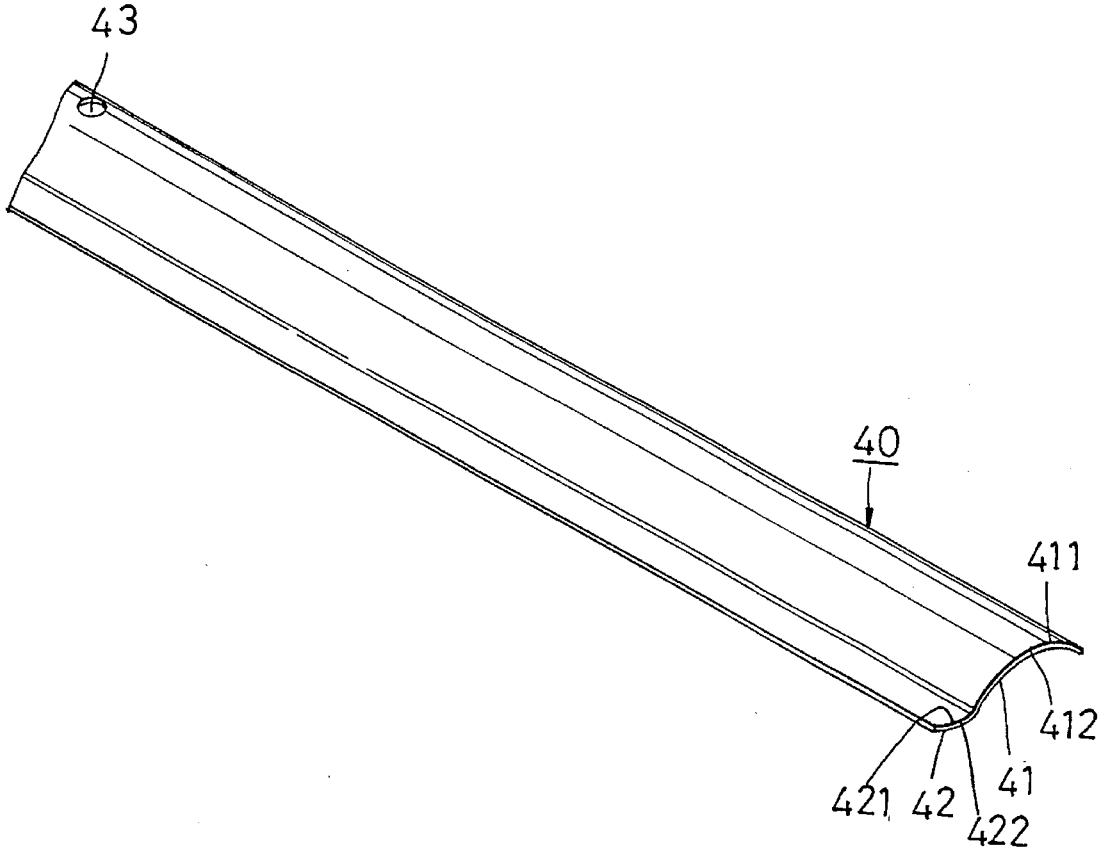
FIG. 4 is a perspective view of a slat of the preferred embodiment of the Venetian blind of this invention.

Referring to FIG. 4, the slat 40 has a substantially S-shaped cross-section with a wider first curving portion 41 extending along a lengthwise direction of the slat 40. The wider first curving portion 41 is connected to a narrower second curving portion 42. The direction of the first curving portion 41 is opposite to that of the second curving portion 42. That is, the wider first curving portion 41 protrudes upwardly while the narrower second curving portion 42 hollows out downwardly. The first curving portion 41 has a wider convex side 411 and an opposite wider concave side 412. Likewise, the second curving portion 42 has a narrower concave side 421 and an opposite narrower convex side 422. The first curving portion 41 is provided with through holes 43 in two end portions thereof for passage of the pull ropes 30 therethrough. Preferably, the size and shape of the through holes 43 correspond to the cross-sectional size and shape of the respective one of the pull ropes 30. The tilting cords 50 are disposed on the respective side of the curving portions 41, 42. The suspending strings 60 are provided directly below each of the slats 40. Through the cooperation of the tilting cords 50 with the suspending strings 60, the slats 40 are restricted and spaced relative to each other under the top housing 10.

Figure 5:
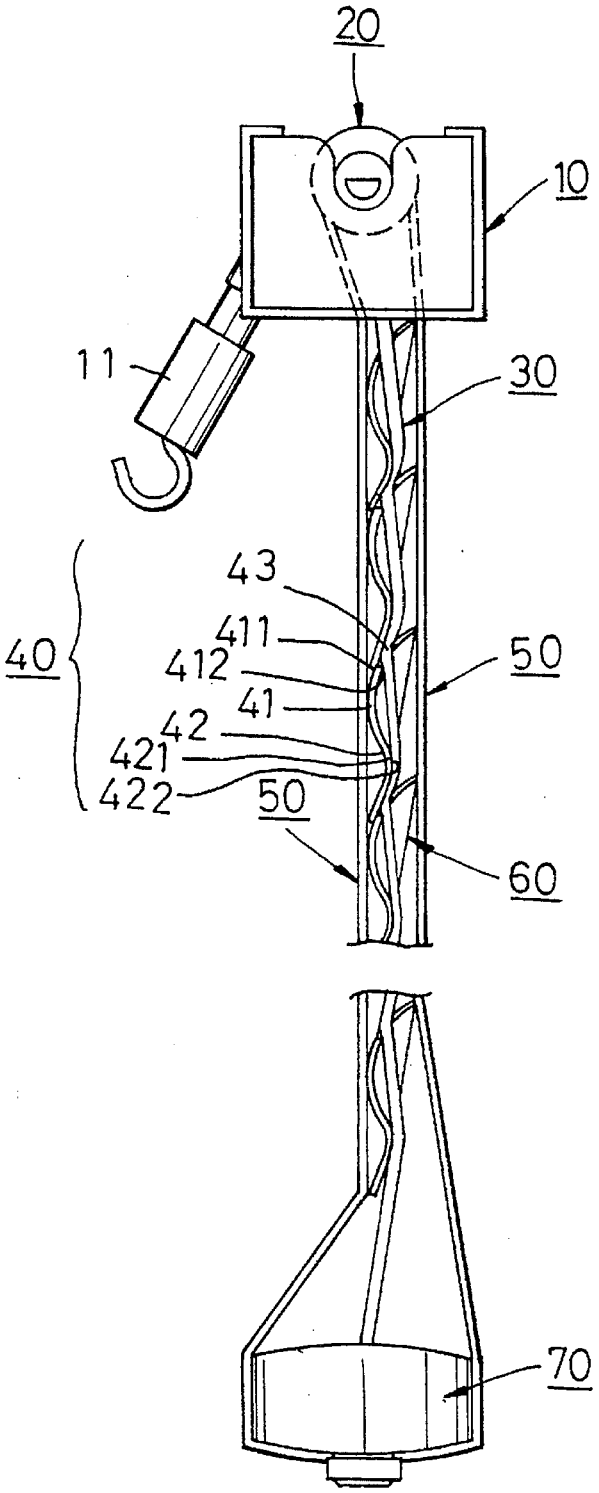
FIG. 5 is a schematic view illustrating the preferred embodiment of the Venetian blind of this invention when in a closed state.

Referring again to FIG. 3, an appropriate distance is maintained between each of the slats 40 of the Venetian blind when the latter is in an open state. Therefore, outdoor light can irradiate a room. On the other hand, as shown in FIG. 5, upon rotating an operating handle 11 to drive rotatably the shaft 20, the tilting cords 50 on the side of the first curving portion 41 of the slat 40 will move upward slightly, while the tilting cords 50 on the side of the second curving portion 42 will move downward slightly. With the relative movement of the tilting cords 50 on the two sides of the slats 40, the suspending strings 60 are tilted so that the outer ends thereof are higher than the inner ends thereof. The first curving portion 41 continuously ascends while the second curving portion 42 continuously descends until the narrower convex side 422 of an upper slat 40 contacts the wider convex side 411 of a lower slat 40.

As shown in FIG. 5, the through holes 43 are provided near the side of the first curving portions 41 of the slats 40 so that, when the slats 40 are operated to a substantially upright orientation, the distance between the tilting cords 50 and the pull ropes 30 is small enough to ensure that the slats 40 contact each other closely. The narrower convex side 422 on the second curving portion 42 of an upper slat 40 contacts closely the wider convex side 411 of a lower slat 40. The two slats 40 are in close contact by virtue of the curved surfaces thereof.

Moreover, since the narrower convex side 422 of an upper slat 40 is in close contact with the wider convex side 411 of a lower slat 40, when the outdoor light strikes the narrower convex side 422, light is not reflected so as to pass through the slats 40. Thus, an excellent light-blocking effect can be achieved.

With this invention thus explained, it is apparent that numerous modifications and variations can be made without departing from the scope and spirit of this invention. It is therefore intended that this invention be limited only as indicated in the appended claims.

I claim:

1. A Venetian blind comprising:

an elongated top housing;

a horizontally disposed shaft journaled in said top housing;

a plurality of horizontal slats suspended one above another, each of said slats having two opposite longitudinal edges and being formed with two through holes;

a bottom rail disposed below said slats;

a pair of pull ropes wound around said shaft, each of said pull ropes passing through said housing and through a respective one of said through holes of said slats and being mounted to said bottom rail;

two pairs of tilting cords, each of said pairs of tilting cords being disposed on a respective one of said opposite longitudinal edges of said slats and having an upper end mounted to said shaft and a lower end mounted to said bottom rail; and a plurality of suspending strings disposed below each of said slats and connecting one of said pairs of tilting cords to the other one of said pairs of tilting cords, wherein:

each of said slats is formed as a one-piece slat body with a substantially S-shaped cross-section;

each of said slats has a wider first curving portion with an upwardly curving cross-section and a narrower second curving portion with a downwardly curving cross-section;

said through holes are formed respectively in two end sections of said first curving portion adjacent to one of said longitudinal edges of said slat;

each of said slats is tiltable between an open position, in which said slats are substantially parallel with one another and each of said slats defines a clearance with an adjacent one of said slats to permit passage of light through said clearance, and a closed position, in which a lower convex surface of said second curving portion of each of said slats is in close contact with an upper convex surface of said first curving portion of a lower adjacent one of said slats so as to prevent passage of light through said slats.

2. The Venetian blind according to claim 1, wherein each of said through holes has a size and shape corresponding to size and shape of cross-section of a respective one of said pull ropes.

* * * * *